US010225674B2

(12) United States Patent
Olsson et al.

(10) Patent No.: US 10,225,674 B2
(45) Date of Patent: Mar. 5, 2019

(54) ROBUST NOISE CANCELLATION USING UNCALIBRATED MICROPHONES

(71) Applicant: GN Netcom A/S, Ballerup (DK)

(72) Inventors: Rasmus Kongsgaard Olsson, Ballerup (DK); Martin Rung, Ballerup (DK)

(73) Assignee: GN Netcom A/S (DK)

( * ) Notice: Subject to any disclaimer, the term of this patent is extended or adjusted under 35 U.S.C. 154(b) by 0 days.

(21) Appl. No.: 15/862,033

(22) Filed: Jan. 4, 2018

(65) Prior Publication Data

US 2018/0167754 A1 Jun. 14, 2018

Related U.S. Application Data

(63) Continuation of application No. 14/871,031, filed on Sep. 30, 2015.

(30) Foreign Application Priority Data

Oct. 8, 2014 (EP) ..... 14188081

(51) Int. Cl.
*H04R 29/00* (2006.01)
*G10L 21/0216* (2013.01)
(Continued)

(52) U.S. Cl.
CPC ..... *H04R 29/005* (2013.01); *G10L 21/0216* (2013.01); *H04R 1/1083* (2013.01);
(Continued)

(58) Field of Classification Search
None
See application file for complete search history.

(56) References Cited

U.S. PATENT DOCUMENTS 7,346,176 B1 3/2008 Bernardi et al.
7,561,700 B1 7/2009 Bernardi et al.
(Continued)

FOREIGN PATENT DOCUMENTS

EP 1640971 3/2006
WO WO 2005/006808 1/2005

OTHER PUBLICATIONS

Van Compernolle D.; "Switching adaptive filters for enhancing noisy and reverberant speech from microphone array recording", Apr. 3, 1990; Apr. 3, 1990—19901/20/2005, pp. 833-836, XP010641865.

(Continued)

*Primary Examiner* — James K Mooney
(74) *Attorney, Agent, or Firm* — Altera Law Group, LLC

(57) ABSTRACT

Disclosed is a method for optimizing noise cancellation in a headset, the headset comprising a headphone and a microphone unit comprising at least a first microphone and a second microphone, the method comprising:

generating at least a first audio signal from the at least first microphone, where the first audio signal comprises a speech portion from a user of the headset and a noise portion from the surroundings;

generating at least a second audio signal from the at least second microphone, where the second audio signal comprises a speech portion from the user of the headset and a noise portion from the surroundings;

generating a noise cancelled output by filtering and summing at least a part of the first audio signal and at least a part of the second audio signal, where the filtering is adaptively configured to continually minimize the power of the noise cancelled output, and where the filtering is adaptively configured to continually provide that at least the amplitude spectrum of the speech portion of the noise cancelled output corresponds to the (Continued)

speech portion of a reference audio signal generated from at least one of the microphones.

16 Claims, 4 Drawing Sheets

(51) Int. Cl.
*H04R 1/10* (2006.01)
*H04R 3/00* (2006.01)

(52) U.S. Cl.
CPC .... *H04R 3/007* (2013.01); *G10L 2021/02165* (2013.01); *H04R 2410/01* (2013.01)

(56) References Cited

U.S. PATENT DOCUMENTS 8,693,703 B2 4/2014 Rung
2007/0055505 A1 3/2007 Doclo
2007/0230712 A1* 10/2007 Belt ..... G10L 21/0208 381/71.1
2008/0201138 A1* 8/2008 Visser ..... G10L 21/0208 704/227
2012/0020485 A1 1/2012 Visser
2015/0003623 A1* 1/2015 Rasmussen ..... G10K 11/002 381/71.6

OTHER PUBLICATIONS

Jinsoo Jeong; "Analysis of system identification and modified application to two-microphone speech enhancement", International Journal of Circuits, Systems and Signal Processing, Issue 2, vol. 3, 2009, Jan. 1, 2009, pp. 92-101, XP55174506.
Jeff Vanden Berghe; "An adaptive noise canceller for hearing aids using two nearby microphones", The Journal of the Acoustical Society of America, American Institute of Physics for the Acoustical Society of America, New York, NY, USA, vol. 103, No. 6, Jun. 1, 1998, pp. 3621-3626, XP012000334, ISSN: 0001-4966.
Extended European Search Report for European application No. 14188081 dated Mar. 18, 2015.
European Office Action dated Dec. 6, 2018 for European patent application No. 14188081.5.
Griffiths L J et al.: "An Alternative Approach to Linearly Constrained Adaptive Beamforming", IEEE Transactions on Antennas and Propagation, IEEE Service Center, Piscataway, NJ, US, vol. AP-30, No. 1, Jan. 1, 1982, pp. 27-34, XP000608836, ISSN: 0018-926X, DOI: 10.1109/TAP.1982.1142739.

* cited by examiner

ROBUST NOISE CANCELLATION USING UNCALIBRATED MICROPHONES

FIELD

This invention generally relates to a method for optimizing noise cancellation in a headset, the headset comprising a headphone and a microphone unit comprising at least a first microphone and a second microphone. More generally, the method relates to generating at least a first audio signal from the at least first microphone, where the first audio signal comprises a speech portion from a user of the headset and a noise portion from the surroundings; and generating at least a second audio signal from the at least second microphone, where the second audio signal comprises a speech portion from the user of the headset and a noise portion from the surroundings.

BACKGROUND

Noise cancelling microphones are used to reduce ambient background noise in headsets with microphone booms.

The performance of a noise-cancelling microphone depends on its positioning relative to the headset user's mouth—it is calibrated to one particular distance and angle relative to the mouth. When it is incorrectly positioned, e.g., when the microphone boom is directed below or above the mouth, the speech pickup characteristics, such as the mouth-to-line transfer function, change. The sensitivity is significantly lowered, meaning that transmitted speech is unacceptably soft. Noise pickup on the other hand is relatively unaffected by mispositioning of the microphone, leading to a decreased signal-to-noise ratio in the transmitted signal. The frequency response of the speech pickup may also change due to the mispositioning, the lower frequencies of the transmitted speech being attenuated relative to the higher frequencies.

The fundamental limitation of a noise-cancelling microphone lies in the fact that the spatial sensitivity is fixed at production. If due to mispositioning of the microphone boom, user speech does not originate from the predetermined position, i.e. distance and direction relative to the microphone assembly, the signal-to-noise ratio of the transmitted signal will be suboptimal. In the following positioning refers to distance between the mouth and the microphone assembly as well as the orientation of the microphone assembly.

An omnidirectional microphone is less sensitive to positioning. This means that in cases of incorrect microphone boom positioning, it is disadvantageous to use a noise-cancelling microphone relative to using an omnidirectional microphone.

Experience shows that users of headsets often position their microphone boom incorrectly, hence the need for an alternative solution.

Dual microphone DSP solutions, termed beamformers in the following, consisting of two omnidirectional microphones in a microphone assembly may replace and improve on a noise cancelling microphone. This is done in great part by maintaining an adaptive spatial sensitivity to fit all or some positionings of the microphone boom/microphone pair. Typical omni-directional microphones used in such systems are produced with a variance of the amplitude and phase response of the individual microphones. In addition, the microphone responses change unpredictably across time in response to temperature, humidity, mechanical shocks and other factors (drift). The response variance cannot be ignored if satisfactory noise cancelling performance is to be achieved. Depending on the specific noise cancelling application, the variance of microphone sensitivities may be handled in one of two ways, representing different problem sets:

1. Microphone sensitivities are calibrated by some process which requires one or more active sound sources at a known position with respect to distance and/or angle. Calibration may occur at production or when the system is in use. A calibration fixture may be used as part of the manufacturing process. User speech may be used if the microphone boom/noise cancelling microphone is in a known position relative to the mouth. Background noise may be used if certain characteristics about it are known. This approach does not handle drift.
2. Use a system which inherently works optimally for all instances of microphone sensitivies and positions of microphone boom/microphone pair but does not explicitly or implicitly compute the position or mispositioning. It does not rely on a sound source at known position at any time for calibration purposes, because such a situation does not occur in lifetime of the noise cancelling application. Since microphone sensitivity and position of the microphone boom/microphone pair are convolved and inseparable effects (see later), it is impossible to explicitly or implicitly extract knowledge from the observed signals of the microphone sensitivities or the position of the microphone boom/microphone pair.

U.S. Pat. No. 7,346,176 (Plantronics) and U.S. Pat. No. 7,561,700 (Plantronics) disclose a system and method which detects whether or not a microphone apparatus is positioned incorrectly relative to an acoustic source and of automatically compensating for such mispositioning. A position estimation circuit determines whether the microphone apparatus is mispositioned. A controller facilitates the automatic compensation of the mispositioning. This system and method requires pre-calibration of the microphones.

U.S. Pat. No. 8,693,703 (GN Netcom) discloses a method of combining at least two audio signals for generating an enhanced system output signal is described. The method comprises the steps of: a) measuring a sound signal at a first spatial position using a first transducer, such as a first microphone, in order to generate a first audio signal comprising a first target signal portion and a first noise signal portion, b) measuring the sound signal at a second spatial position using a second transducer, such as a second microphone, in order to generate a second audio signal comprising a second target signal portion and a second noise signal portion, c) processing the first audio signal in order to phase match and amplitude match the first target signal with the second target signal within a predetermined frequency range and generating a first processed output, d) calculating the difference between the second audio signal and the first processed output in order to generate a subtraction output, e) calculating the sum of the second audio signal and the first processed output in order to generate a summation output, f) processing the subtraction output in order to minimise a contribution from the noise signal portions to the system output signal and generating a second processed output, and g) calculating the difference between the summation output and the second processed output in order to generate the system output signal.

Thus, it remains a problem to obtain robust and optimal noise cancellation in a headset regardless of the position of the microphones using uncalibrated microphones.

SUMMARY

Disclosed is a method for optimizing noise cancellation in a headset, the headset comprising a headphone and a microphone unit comprising at least a first microphone and a second microphone, the method comprising:

generating at least a first audio signal from the at least first microphone, where the first audio signal comprises a speech portion from a user of the headset and a noise portion from the surroundings;

generating at least a second audio signal from the at least second microphone, where the second audio signal comprises a speech portion from the user of the headset and a noise portion from the surroundings;

generating a noise cancelled output by filtering and summing at least a part of the first audio signal and at least a part of the second audio signal, where the filtering is adaptively configured to continually minimize the power of the noise cancelled output, and where the filtering is adaptively configured to continually provide that at least the amplitude spectrum of the speech portion of the noise cancelled output corresponds to the speech portion of a reference audio signal generated from at least one of the microphones.

Consequently, it is an advantage that the filtering is adaptively configured to continually provide that at least the amplitude spectrum of the speech portion of the noise cancelled output corresponds to the speech portion of a reference audio signal generated from at least one of the microphones, since hereby the noise is cancelled while maintaining the speech. Thus the speech is not cancelled, which is a problem in prior art headsets performing noise cancellation.

The method described here provides a solution to the problem stated above. The method solves the problem by providing a noise cancelling method where it is avoided to rely on factory calibration, which is an advantage due to its time cost and its inability to handle microphone drift. Furthermore the method solves the problem by avoiding having to assume that the microphone boom and/or microphone pair is in a specific position for calibration in using the user speech, and this an advantage since it is difficult or even impossible to assume anything of the characteristics of the background noise. Furthermore, the method is optimal for all microphone positions.

A noise cancelling microphone system in a headset has the biggest potential for reducing noise from the surroundings if positioned close to the mouth and this requires a long microphone boom. A noise cancelling microphone system can benefit in more ways from being positioned close to the mouth: Close to the mouth is the highest ratio between the speech signal from the mouth and the noise signal from the surroundings. Close to the mouth the amplitude of the speech signal also decreases by the distance to the mouth while the amplitude of the noise signal remains almost constant. A noise cancelling microphone system captures the sound pressure at two points in space. If these are oriented on a line radially from the mouth the amplitude of the speech is different at the two points. The amplitude of the noise from the surroundings is however practically the same at the two points. This property i.e. speech amplitude being different at the two points, is exploited by the noise cancelling microphone for discrimination between speech and noise. This difference in the speech amplitude decreases by increasing distance to the mouth. So at larger distances from the mouth, e.g. if the noise cancelling microphone system is mounted in a short microphone boom, the noise cancelling microphone becomes less effective. Hence, the disclosed method is especially advantageous in long microphone booms that can position the noise cancelling microphone system close to the mouth.

In prior art headsets having a long microphone boom, it is a problem if the user does not arrange the microphone boom according to the ideal position, since then the performance of the headset is seriously reduced as the settings and/or processor of the headset assumes that the microphone boom and thus the microphones are arranged optimally, i.e. close to the mouth of the user. It is a common problem that headset users do not arrange the microphone boom correct, i.e. with the microphones close to the mouth. The present method solves this problem, as the method does not assume anything about the position of the microphones.

With a long microphone boom for example, there will be a large difference in the amplitude of the speech portion from the user depending on where the microphone boom with the microphones is arranged relative to the mouth of the user. However, there may be no or only little difference in the amplitude of the noise portion, thus the noise portions are more or less the same no matter where the microphone boom and the microphones are arranged relative to the mouth of the user. This is due to the fact that the noise comes from the surroundings, i.e from many directions and from the far field. The speech comes only from the mouth of the user, i.e. from approximately one point in space, which is in the near field of the microphones, meaning that the speech portion amplitude is different at the microphones.

If the microphone boom position is changed the noise cancelling microphone system may also change its distance and orientation relative to the mouth. In a simple, fixed noise cancelling microphone it will have strong impact changing the speech amplitude in its output signal. An omni-directional microphone will show smaller changes in the speech amplitude in its output signal. When using omni-directional microphones, the adaptively configured noise cancelling microphone system may use one of its two omni-directional microphones as a reference microphone for the speech and constraint the noise cancelling to transmit the noise cancelled speech with amplitude similar to that of the speech reference.

When the microphone boom position is changed, the front microphone closest to the microphone boom tip is likely to change its distance to the mouth more than the rear microphone on the microphone boom. On the other hand, the distance between the mouth and the rear microphone varies less and so does the speech amplitude at the rear microphone. Hence, the rear microphone is advantageous for providing a speech reference.

Furthermore, it is a problem in prior art headsets, that the microphones are calibrated at the factory before being delivered to the user, and as the microphone characteristic may change over time, due to a number of reasons, such as use, wear, heat etc, the microphones may not be correctly calibrated after a while. The present method solves this problem, as the method does not assume anything about microphone sensitivity, electronics etc.

Sampling may be performed with an A/D converter, fx at 16 kHz.

The filtering is configured to continually adaptively minimize the power of the noise cancelled output. Continually may mean ongoing and regularly, such as one or more times every second, such as every 200 milliseconds, when speech is detected or received in one of the microphones. Preferably, filtering may be performed at all time. Thus the adaption of the filtering is performed continually, such as activated and deactivated by a voice activity detector (VAD) and/or by a non-voice activity detector (NVAD).

Typically the core part of an an adaptive filter or adaptive filter algorithm may not know what is speech and what is noise. It may only adaptively modify a filter so that the output is minimized. However, by putting the adaptive filter in a configuration where it cannot reduce the speech component of the input then minimizing the output effectively is the same as minimizing the noise component in the output. That property is generally referred to as a constraint to the filtering.

In a case where the filtering of the one or more audio signals is adaptively configured by a Generalized Sidelobe Cancellation (GSC) computation, the adaptive filter may only filter and subtract an already speech cancelled signal. Thereby it may not or can not modify the speech component and so minimizing output leads to minimizing the noise in the output.

In a case where the filtering of the one or more audio signals is adaptively configured by a Minimum Variance Distortionless Response (MVDR) computation, the steering vector may represent that constraint.

Thus minimizing the output power leads to minimizing the noise in the output.

The term "corresponds to" may be defined or understood as "is the same as" or "is equal to", thus the feature "the filtering is adaptively configured to continually provide that at least the amplitude spectrum of the speech portion of the noise cancelled output corresponds to the speech portion of a reference audio signal generated from at least one of the microphones" may be termed "the filtering is adaptively configured to continually provide that at least the amplitude spectrum of the speech portion of the noise cancelled output is the same as and/or is equal to the speech portion of a reference audio signal generated from at least one of the microphones."

Beamforming may advantageously be combined with a noise suppressor by applying noise suppression to the output of the beamformer. This is due to the fact that the ratio of user speech to ambient noise, the signal-to-noise ratio (SNR), is improved at the output of the beamformer. Since the level of undesirable processing artifacts from noise suppression generally depends on the SNR, reduced artifact result from the combination of beamforming and noise suppression.

In general, noise suppression may be implemented as described in Y. Ephraim and D. Malah, "Speech enhancement using optimal non-linear spectral amplitude estimation," in Proc. IEEE Int. Conf. Acoust. Speech Signal Processing, 1983, pp. 1118-1121, or as described elsewhere in the literature on noise suppression techniques. Typically, a time-varying filter is applied to the signal. Analysis and/or filtering are often implemented in a frequency transformed domain/filter bank, representing the signal in a number of frequency bands. At each represented frequency, a time-varying gain is computed depending on the relation of estimated desired signal and noise components e.g. when the estimated signal-to-noise ratio exceeds a pre-determined, adaptive or fixed threshold, the gain is steered toward 1. Conversely, when the estimated signal-to-noise ratio does not exceed the threshold, the gain is set to a value smaller than 1.

In general, a way to estimate the signal and noise relation is based on tracking the noise floor, wherein speech or noisy speech is identified by signal parts significantly exceeding the noise floor level. Noise levels may, e.g., be estimated by minimum statistics as in R. Martin, "Noise Power Spectral Density Estimation Based on Optimal Smoothing and Minimum Statistics," Trans. on Speech and Audio Processing, Vol. 9, No. 5, July 2001, where the minimum signal level is adaptively estimated.

Other ways to identify signal and noise parts are based on computing multi-microphone spatial features such as directionality and proximity, see O. Yilmaz and S. Rickard, "Blind Separation of Speech Mixtures via Time-Frequency Masking", IEEE Transactions on Signal Processing, Vol. 52, No. 7, pages 1830-1847, July 2004 or coherence, see K. Simmer et al., "Post-filtering techniques." Microphone Arrays. Springer Berlin Heidelberg, 2001. 39-60. Dictionary approaches decomposing signal into codebook time/frequency profiles may also be applied, see M. Schmidt and R. Olsson: "Single-channel speech separation using sparse non-negative matrix factorization," Interspeech, 2006.

The method may comprise that the microphones output digital signals; a transformation of the digital signals to a time-frequency representation is performed, in multiple frequency bands; and an inverse transformation of at least the combined signal to a time-domain representation is performed.

The transformation may be performed by means of a Fast Fourier Transformation, FFT, applied to a signal block of a predefined duration. The transformation may involve applying a Hann window or another type of window. A time-domain signal may be reconstructed from the time-frequency representation via an Inverse Fast Fourier Transformation, IFFT.

The signal block of a predefined duration may have duration of 8 ms with 50% overlap, which means that transformations, adaptation updates, noise reduction updates and time-domain signal reconstruction are computed every 4 ms. However, other durations and/or update intervals are possible. The digital signals may be one-bit signals at a many-times oversampled rate, two-bit or three-bit signals or 8 bit, 10, bit 12 bit, 16 bit or 24 bit signals.

In alternative implementations/embodiments, all or parts of the system may operate directly in the time-domain. For example, noise suppression may be applied to a time domain signal by means of FIR or IIR filtering, the beamforming and noise suppression filter coefficients computed in the frequency domain.

The method may comprise that the microphones output analogue signals; analogue-to-digital conversion of the analogue signals is performed to provide digital signals; a transformation of the digital signals to a time-frequency representation is performed, in multiple frequency bands; and an inverse transformation of at least the combined signal to a time-domain representation is performed.

With regard to the cited prior art in the Background section, the two patents U.S. Pat. No. 7,346,176 and U.S. Pat. No. 7,561,700 claim solutions to problem type 1, as described in the problem statement section, but do not claim a solution to problem type 2 and the methods described in the prior art would not work for problem type 2, which the method claimed in the present application does.

U.S. Pat. No. 7,346,176 and U.S. Pat. No. 7,561,700 are not compatible with problem type 2, the claimed methods cannot be applied, because the prior art require that a measure of position or misposition is computed, e.g. prior art claims 'a position estimation circuit coupled to receive the audio signals from the first microphone and second microphone, and adapted to produce, from the audio signals from both the first and the second microphones, an error signal to indicate angular and/or distance mispositioning of the acoustic pick-up device relative to the desired . . . '. For the reasons already described, in problem type 2 it is impossible to compute a sensible measure of position or misposition and the method of the present application does not do so.

Thus, the prior art U.S. Pat. No. 7,346,176 and U.S. Pat. No. 7,561,700 describe a solution to a different problem than does this present method. The prior art 'see' the sound field through calibrated microphones requiring conditions for calibration at some point in time, whereas the method of the present application does not. The method of the present application solves the more difficult problem of never having access to conditions which allow for calibration of the microphones.

In some embodiments the reference audio signal is the first audio signal, or the second audio signal, or a weighted average of the first and second audio signals, or a filter-and-sum combination of the first and second audio signal.

In some embodiments at least the amplitude spectrum of the speech portion of the noise cancelled output corresponding to the speech portion of a reference audio signal comprises that at least the amplitude spectrum of the speech portion of the noise cancelled output is proportional or similar to the speech portion of a reference audio signal.

In some embodiments the noise cancellation is configured to be performed regardless/independently/irrespective of the positions and/or sensitivities of the microphones.

In some embodiments filtering one or more of the audio signals is performed by at least one beamformer.

In some embodiments the filtering of the one or more audio signals is adaptively configured by a Generalized Sidelobe Cancellation (GSC) computation.

Generalized sidelobe cancelling, see e.g. Ivan Tashev; Sound Capture and Processing: Practical Approaches, pp. 388, Wiley, July 2009, refers to a beamformer which has a constraint built into the processing structure to conserve a signal of interest, which is the user speech in the headset use case.

The GSC has two computation branches:

The first branch is a reference branch or fixed beamformer, which picks up a mixture of user speech and ambient noise. Examples of reference branches are delay-and-sum beamformers, e.g., summing amplitude and phase signals aligned with respect to the user speech, or one of the microphones taken as a reference. The reference branch should preferably be selected/designed to be as insensitive as possible to the positioning of the microphones relative to the user's mouth, since the user speech response of the reference branch determines the user speech response of the GSC, as explained below. An omni-directional microphone may be suitable due to the fact that it is relatively insensitive, relatively speaking, to position and also to microphone sensitivity variation. In a multi-microphone headset microphone boom design, the rear microphone which is situated nearer to the rotating point of the microphone boom, where the rotating point is typically at or hinged at the earphone of the headset at the user's ear, may be preferable since it is less sensitive to movements of the microphone boom. Thus, preferably this provides no change of the amplitude spectrum of the user speech signal.

The second branch of the GSC computation computes a speech cancelled signal, where the signals are filtered and subtracted, by means of a blocking matrix, in order to reduce the user speech signal as much as possible.

Finally, noise cancelling is performed by the GSC by adaptively filtering the speech cancelled signal(s) and subtracting it from the reference branch in order to minimize the output power. In the ideal case, the speech cancelled signal (ideally) contains no user speech component and hence the subtraction to produce the noise cancelled output does not alter the user speech component present in the reference branch. As a result, the amplitude spectrum of the speech component may be identical or very similar at the GSC reference branch and the output of the GSC beamformer. It may be said that the GSC beamformer's beam is centered on the user speech.

The present method provides means to ensure that the GSC's speech cancelling branch is optimally configured at all times. If the speech cancelling filters are not accurately configured, user speech leaks into the speech cancelled branch. As a consequence, the GSC noise cancelling operation will alter the user speech response in an undesirable way, i.e. the GSC beamformer's beam will no longer be centered on the user speech. The present method proposes to continually adapt the speech cancelling filters to minimize speech leakage into the speech cancelled branch. The minimization procedure may be carried out using any optimization procedure at hand, e.g. least-mean-squares. The minimization procedure may advantageously be controlled by a voice-activity detector to minimize the speech leakage, preventing disturbance from ambient noise contribution.

The adapted speech cancelling filter blindly combines and compensates for user speech response differences between the microphones stemming from the microphone amplitude and phase responses, input electronic responses and acoustic path responses. The acoustic path responses depend on the position of microphones on the microphone boom, the position of the microphone boom, the geometry of a given user's head and the sound field produced from the mouth, shoulder reflections and other reflections. As all these effects are linear they may be treated with one common linear speech cancelling filter according to the present method.

An example of a GSC system can be seen in FIG. 1 where audio signals 107 and 104 are the reference branch and speech cancelling branches, respectively. The speech cancelling branch is computed by continually updating the speech cancelling filter 109 to align the two inputs with respect to the user voice or speech component. The reference branch is computed by averaging the aligned inputs audio signals 102 and 103. The speech cancelling branch is conditioned using the fixed filter 110 in order for the noise cancelling adaptivity 111 to be kept real and within certain numerical bounds. Further the noise cancellation operation may run without a VAD.

In order to increase the robustness of the GSC system even further, a voice activity detector may be employed to disable or moderate the adaptation of the GSC noise cancelling filter when user voice or speech is detected. In that way the GSC will be further prevented from adapting the noise cancelling filter to inadvertently cancel the user speech.

Thus a generalised sidelobe canceller (GSC) system or computation may be used in the method as well as other systems, such as a Minimum Variance Distortionless Response (MVDR) computation or system.

In some embodiments the filtering of the one or more audio signals is adaptively configured by a Minimum Variance Distortionless Response (MVDR) computation.

Minimum variance distortionless response (MVDR) refers to a beamformer which minimizes the output power of the filter-and-sum beamformer, see FIG. 4, subject to a single linear constraint. The solution may be obtained through a one-step, closed-form solution. Often, the constraint or the steering vector is selected so that the beamformer maintains a uniform response in a look direction, i.e. the beam points in a direction of interest. The present method advantageously designs the steering vector so that the amplitude spectrum of the user voice or speech component is identical at the input, i.e. the reference, and outputs of the MVDR beamformer.

The MVDR beamformer computations are briefly summarized below for a single frequency band. The signal model, i'th input, $$x_i = c_i s + n_i$$

where s and $n_i$ are the user speech and i'th ambient noise signals, respectively. $c_i$ is the complete i'th complex response incorporating the microphone amplitude and phase responses, input electronic responses and acoustic path responses.

The filter-and-sum beamformer may be written, $$y = w^H x$$

The MVDR beamformer minimizes the output subject to a normalization constraint, $$w_{MVDR} = \text{argmin}_w \langle |y|^2 \rangle$$

$$\text{subject to } w^H a = q$$

The closed form solution to the MVDR cost function is, $$w_{MVDR} = \frac{C^{-1} a}{a^H C^{-1} a},$$

where C and a are the noise covariance matrix and the steering vector, respectively.

In one embodiment of the invention, the steering vector a, and q=1, is selected in order to constrain the beamformer's voice or speech response to be equal to a 'best' reference microphone. Selecting the most advantageous microphone in the interest of being robust to microphone boom positioning is described above for the GSC beamformer.

Constraining the beamformer's voice or speech response to be equal to the reference, i.e. 'best', microphone is achieved by using the relative mouth-to-mic transfer functions as steering vector $$a_i = \frac{c_i}{c_{ref}},$$

where the fraction $a_i$ may be approximated without having access to the $c_i$ by estimating the complex transfer function from the i'th microphone to the reference microphone of the user speech component. In analogy to the GSC system, this may be achieved using a voice activity detector (VAD) control and by minimizing a speech leakage cost function.

As a result, the user speech component is identical or similar in the reference microphone and at the output of the MVDR beamformer. This is proved below:

$$y = w^H x_{voice} = \sum_{i=1}^{M} w_i^* c_i s = c_{ref} \sum_{i=1}^{M} w_i^* \frac{c_i}{c_{ref}} s = c_{ref} \cdot 1 \cdot s$$

Further in analogy to the GSC system, the noise covariance matrix may be estimated and updated when a VAD indicates that the user speech component will not contaminate the estimate too much.

The steering vector, the noise covariance estimated and the MVDR solution may be updated at suitable intervals, for example each 4, 10 or 100 ms, balancing computational costs with noise cancelling benefits. A regularization term may be added to the noise covariance estimate.

In some embodiments the MVDR computation comprises a steering vector which is continually adapted to the speech portion of the audio signals.

Thus this an example of how to adapt Minimum Variance Distortionless Response (MVDR) computation.

In some embodiments the MVDR steering vector is adapted to continually provide that at least the amplitude spectrum of the speech portion of the noise cancelled output corresponds to the speech portion of a reference audio signal generated from at least one of the microphones.

In some embodiments the MVDR computation comprises a noise covariance matrix which is continuously adapted to the noise portion in the audio signals.

In some embodiments the method comprises performing a noise suppression on the noise cancelled output speech signal.

In some embodiments the method comprises applying a speech level normalizing gain to the noise cancelled output speech signal.

Noise cancelling constrained to transmit speech similar to that captured by a reference microphone can advantageously be combined with subsequent Speech Level Normalization (SLN). SLN can as input receive a signal containing speech at some level and apply a gain to that in order to output a signal with the speech at a defined normalized level. SLN detects the presence and the input level of the speech and calculates and applies a normalizing gain. However, the wider input level range the SLN shall accommodate, the more difficult the task becomes and the higher the risk of artefacts and erroneous gains becomes.

Compared to a simple, fixed noise cancelling the noise cancelling constrained to transmit speech similar to that captured by a reference microphone reduces the range of speech levels that occur by changing microphone boom position. SLN can much better and with fewer artefacts reduce these reduced residual speech level variations.

Thus it is an advantage to have a gain which continually normalises the speech level. This speech level normalizing gain is performed or placed after the actual noise cancellation, as described above, has been performed. The speech level normalizing gain will further reduce level differences from fx different microphone positions.

In some embodiments the first and the second microphones are uncalibrated.

In prior art headsets, the precise relative sensitivity of the microphones must be known in order for beamforming to work reliably. Since the sensitivity of the microphones will change over their lifetime, e.g. due to environmental factors, the beamforming will work poorly after some time if the microphones are not regularly calibrated. It is an advantage that the microphones of the present application do not need calibration and do not need to be recalibrated in order to work properly. The method of the present application does not assume anything about the microphones, and the method works to take account of uncalibrated microphones.

In some embodiments the first microphone is a front microphone and the second microphone is a rear microphone of a microphone boom of the headset.

In some embodiments the front microphone and the rear microphone are arranged along the length axis of the microphone boom, so that the front microphone is configured to be arranged closer to the mouth of the user than the rear microphone.

The front microphone may be arranged in the tip of the microphone boom, and the rear microphone may be arranged between the front microphone and the headphone.

In some embodiments the microphones are arranged along an axis from the mouth of the user to the surroundings.

In some embodiments the first microphone and/or second microphone is an omnidirectional microphone.

In some embodiments the first and the second microphones are arranged at a distance, so that the speech portions in the first and in the second audio signals are different.

Filtering may be performed continually in all the systems or filters of the headset, and one of the filters in the generalised sidelobe canceller (GSC) is adapted continually when speech is detected.

In some embodiments adaptation of the filtering of at least part of the one or more audio signals is performed, when speech from the user is detected.

In some embodiments the GSC speech cancelling filtering of the one or more audio signals is continually adapted, when speech from the user is detected.

Thus filtering of the one or more audio signals is continually adapted by the GSC computation.

In some embodiments adaption of the steering vector in the MVDR is performed when speech from the user is detected.

In some embodiments the speech is detected by means of a voice activity detector (VAD).

A voice activity detector, VAD, of a single-input type, may be configured to estimate a noise floor level, N, by receiving an input signal and computing a slowly varying average of the magnitude of the input signal. A comparator may output a signal indicative of the presence of a speech signal when the magnitude of the signal temporarily exceeds the estimated noise floor by a predefined factor of, say, 10 dB. The VAD may disable noise floor estimation when the presence of speech is detected. Such a speech detector works when the noise is quasi-stationary and when the magnitude of speech exceeds the estimated noise floor sufficiently. Such a voice activity detector may operate at a band-limited signal or at multiple frequency bands to generate a voice activity signal aggregated from multiple frequency bands. When the voice activity detector works at multiple frequency bands, it may output multiple voice activity signals for respective multiple frequency bands.

A voice activity detector, VAD, of a multiple-input type, may be configured to compute a signal indicative of coherence between multiple signals. For example, the speech signal may exhibit a higher level of coherence between the microphones due to the mouth being closer to the microphones than the noise sources. Other types of voice activity detectors are based on computing spatial features or cues such as directionality and proximity, and, dictionary approaches decomposing signal into codebook time/frequency profiles.

In some embodiments the adaption of the filtering of at least part of the one or more audio signals is performed, when no speech from the user is detected.

In some embodiments adaptation of the noise covariance/portion is performed when no speech from the user is detected.

In some embodiments adaption of the noise covariance input to the MVDR computation is performed, when no speech from the user is detected.

Thus the noise covariance input is calculated to be used by the MVDR computation.

In some embodiments noise and/or non-speech is detected by means of a non-voice activity detector (NVAD).

In some embodiments filter adaptation through noise power minimization is performed when speech from the user is detected to be absent.

In some embodiments the GSC noise cancelling filter adaptation is performed, when speech from the user is detected to be absent.

Thus the noise cancelling filter adaption through noise power minimization is performed by the GSC computation.

In some embodiments the method comprises normalising the first audio signal to the second audio signal.

In some embodiments the method comprises normalising the speech portion of first audio signal to the speech portion of second audio signal.

When normalising the speech portion of the first audio signal to the speech portion of the second audio signal, the noise portion of the first audio signal may also be affected, such as normalised to the noise portion of the second audio signal.

In some embodiments normalising the speech portion of the first audio signal to the speech portion of the second audio signal comprises delaying and attenuating the first audio signal.

In some embodiments filtering at least part of the one or more audio signals comprises providing a FIR filter and/or a gain/delay operation.

The present invention relates to different aspects including the method described above and in the following, and corresponding methods, devices, headsets, headphones, systems, kits, uses and/or product means, each yielding one or more of the benefits and advantages described in connection with the first mentioned aspect, and each having one or more embodiments corresponding to the embodiments described in connection with the first mentioned aspect and/or disclosed in the appended claims.

In particular, disclosed herein is a headset for voice communication, the headset comprising:

a speaker, at least a first and a second microphone for picking up incoming sound and generating a first audio signal generated at least partly from the at least first microphone and a second audio signal being at least partly generated from the at least second microphone, wherein the first audio signal and the second audio signal comprise a speech portion from a user of the headset and a noise portion from the surroundings;

a signal processor being configured to:

generating a noise cancelled output by filtering and summing at least a part of the first audio signal and at least a part of the second audio signal, where the filtering is adaptively configured to continually minimize the power of the noise cancelled output, and where the filtering is adaptively configured to continually provide that at least the amplitude spectrum of the speech portion of the noise cancelled output corresponds to the speech portion of a reference audio signal generated from at least one of the microphones.

In some embodiments the headset further comprises a microphone boom and wherein the at least first and second microphones are positioned along the microphone boom so that the first microphone is a front microphone and the second microphone is a rear microphone of the microphone boom.

In some embodiments the first and the second microphones are uncalibrated.

In some embodiments the first microphone and/or the second microphone is an omnidirectional microphone.

In some embodiments the first and the second microphones are arranged at a distance, so that the speech portions in the first and in the second audio signals are different.

In some embodiments the microphone boom is rotatable around a fixed point, where the fixed point is adapted to be arranged at an ear of a user of the headset.

In some embodiments the microphone boom is adjustable, such as the microphone boom is configured with an adjustable length, an adjustable angle of rotation, and/or adjustable microphone positions. The microphone boom may move flexibly, such as rotate and turn in any or all directions.

In some embodiments the microphone boom has a length equal to or greater than 100 mm.

Thus the microphone boom may have a length of at least 100 mm, such as at least 110 mm, 120 mm, 130 mm, 140 mm, 150 mm. Microphone booms with these length are also called long microphone booms and are typically used in office headsets and call center headset.

According to an aspect disclosed is a method for performing noise cancellation in a headset, the headset comprising a headphone and a microphone unit comprising at least a first microphone and a second microphone, the method comprising:

generating at least a first audio signal from the at least first microphone, where the first audio signal comprises a speech portion from a user of the headset and a noise portion from the surroundings;

generating at least a second audio signal from the at least second microphone, where the second audio signal comprises a speech portion from the user of the headset and a noise portion from the surroundings;

continually normalising the first audio signal relative to the second audio signal to provide a third audio signal, where the normalisation is performed with respect to the speech portions, whereby the speech portion of the third audio signal corresponds to the speech portion of the second audio signal;

subtracting the third audio signal from the second audio signal to provide a fourth audio signal comprising the noise difference between the third and second audio signals;

continually filtering the fourth audio signal to provide a fifth audio signal comprising a noise portion corresponding to the noise portion of the second audio signal;

obtaining a noise cancelled output speech signal by subtracting the fifth audio signal from a sixth audio signal comprising at least a part of the second audio signal.

Filtering is performed to adaptively minimize the power, or other metric, of the noise difference.

According to another aspect disclosed is a method for optimizing noise cancellation in a headset irrespective of microphone position and/or microphone sensitivity, the headset comprising a headphone and a microphone unit comprising at least a first microphone and a second microphone, the method comprising:

generating at least a first audio signal from the at least first microphone, where the first audio signal comprises a speech portion from a user of the headset and a noise portion from the surroundings;

generating at least a second audio signal from the at least second microphone, where the second audio signal comprises a speech portion from the user of the headset and a noise portion from the surroundings;

filtering the first audio signal in a first filter to generate a first filtered audio signal, the first filter comprising at least a microphone sensitivity dependent component and/or a microphone position dependent component;

processing at least the speech portion of the first filtered audio signal and at least the speech portion of the second audio signal to generate a feedback signal;

receiving the feedback signal in the first filter;

adaptively adjusting at least the microphone sensitivity dependent component and/or the microphone position dependent component in the first filter in response to the received feedback signal; and generating a noise cancelled output signal.

The noise cancelled output signal can be generated from one or more of the audio signals, such as the first and/or second audio signal, the first filtered audio signal, a second filtered audio signal, a weighted average of the first and second audio signals, and/or a filter-and-sum combination of the first and second audio signal.

In some embodiments the processing comprises generating a noise difference signal between the first filtered audio signal and the second audio signal.

In some embodiments the sixth audio signal comprises an average of the second audio signal and the third audio signal. This may possibly be filter-and-sum.

In some embodiments the method comprises summing the second audio signal with the third audio signal to obtain a seventh audio signal. Due to the filtering, the speech portions are substantially the same for these two audio signals and thus the audio signals can be summed.

In some embodiments the method comprises multiplying or avering the seventh audio signal with a multiplication factor of one half (½) to provide the sixth audio signal. This may be performed because the sixth audio signal is a summation of the second and third audio signals.

In some embodiments normalising the first audio signal relative to the second audio signal is performed when speech from the user is detected.

Adaption of the steering vector in the MVDR computation can also be enabled when speech from the user is detected by a voice activity detector (VAD).

In some embodiment normalising the first audio signal and/or the filtering of the fourth audio signal is/are an adaptive feedback process.

In some embodiments filtering of the fourth audio signal comprises using a least mean square algorithm or other optimisation algorithm.

In some embodiments normalising the first audio signal to the second audio signal comprises aligning the first and the second audio signals with respect to acoustic paths, microphone sensitivities and/or input electronics.

This is an advantage, since the microphones may not be calibrated.

Aligning the first and second audio signals may be performed continually, such as regularly, such as one or more times every second, such as one or more times every 200 ms.

In some embodiments normalising the first audio signal to the second audio signal comprises delaying and attenuating the speech portion of the first audio signal to correspond to the speech portion of the second audio signal.

In some embodiments normalising the first audio signal to the second audio signal comprises providing a FIR filter or a gain/delay operation.

In some embodiments normalising the first audio signal to the second audio signal comprises providing phase matching and/or amplitude matching of the speech portion of the first audio signal relative to the speech portion of the second audio signal within a predetermined frequency range.

BRIEF DESCRIPTION OF DRAWINGS

The above and/or additional objects, features and advantages of the present invention, will be further elucidated by the following illustrative and non-limiting detailed description of embodiments of the present invention, with reference to the appended drawings, wherein.

DESCRIPTION

In the following description, reference is made to the accompanying figures, which show by way of illustration how the invention may be practiced.

Figure 1:
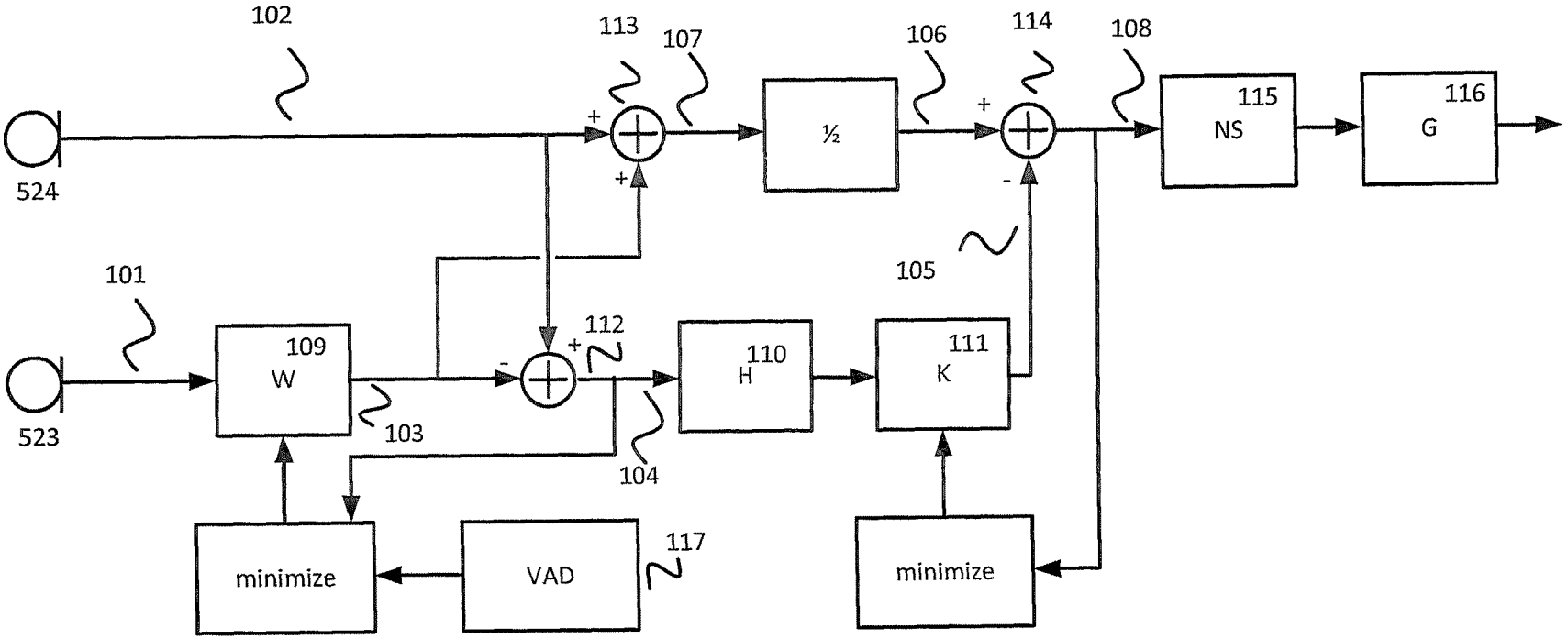
FIG. 1 shows an example of a diagram of the audio signals in a headset performing a method for optimizing noise cancellation in a headset.

FIG. 1 shows an example of a diagram of the audio signals in a headset performing a method for optimizing noise cancellation in a headset, the headset comprising a headphone and a microphone unit comprising at least a first microphone 523 and a second microphone 524, the method comprising:

generating at least a first audio signal 101 from the at least first microphone 523, where the first audio signal 101 comprises a speech portion from a user of the headset and a noise portion from the surroundings;

generating at least a second audio signal 102 from the at least second microphone 524, where the second audio signal 102 comprises a speech portion from the user of the headset and a noise portion from the surroundings;

generating a noise cancelled output 108 by filtering W 109, H 110, K 111, and summing 112, 113, 114 at least a part of the first audio signal 101 and at least a part of the second audio signal 102, where the filtering 109, 110, 111, is adaptively configured to continually minimize the power of the noise cancelled output 108, and where the filtering 109, 110, 111 is adaptively configured to continually provide that at least the amplitude spectrum of the speech portion of the noise cancelled output 108 corresponds to the speech portion of a reference audio signal generated from at least one of the microphones 523, 524.

The beamformers of the method may thus be produced through the filters W 109, H 110 and K111, including the optimal, e.g, in a mean square sense.

For minimizing input mismatch, filter W 109 may be adapted online for normalized speech pickup relative to the rear or second microphone 524.

The filter K 111 (real) may be adapted online and filter H 110 may be adapted offline for near-optimal noise cancellation in terms of mean square error.

Dual microphone noise suppression (NS) 115 is facilitated and applied.

Gain 116 may be controlled by Speech Level Normalization (SLN).

FIG. 1 also shows an example of a Generalized Sidelobe Canceller (GSC) system, where audio signals 107 and 104 are the reference branch and speech cancelling branches, respectively, of the GSC system. The speech cancelling branch is computed by continually updating the speech cancelling filter W 109 to align the two inputs with respect to the user voice or speech component. The reference branch is computed by averaging the aligned inputs, audio signals, 102 and 103. The speech cancelling branch is conditioned using the fixed filter H 110 in order for the noise cancelling adaptivity K 111 to be kept real and within certain numerical bounds. Further the noise cancellation operation may run without a voice activity detector (VAD) 117.

In order to increase the robustness of the GSC system even further, a voice activity detector (VAD) 117 may be employed to disable or moderate the adaptation of the GSC noise cancelling filter when user voice or speech is detected. In that way the GSC will be further prevented from adapting the noise cancelling filter to inadvertently cancel the user speech.

FIG. 1 also shows an example of a method for performing noise cancellation in a headset, the headset comprising a headphone and a microphone unit comprising at least a first microphone 523 and a second microphone 524, the method comprising:

generating at least a first audio signal 101 from the at least first microphone 523, where the first audio signal 101 comprises a speech portion from a user of the headset and a noise portion from the surroundings;

generating at least a second audio signal 102 from the at least second microphone 524, where the second audio signal 102 comprises a speech portion from the user of the headset and a noise portion from the surroundings;

continually normalising 109 the first audio signal 101 relative to the second audio signal 102 to provide a third audio signal 103, where the normalisation 109 is performed with respect to the speech portions, whereby the speech portion of the third audio signal 103 corresponds substantially to the speech portion of the second audio signal 102, thus the filter W 109 delays and attenuates the speech portion from the first microphone 523 so that it substantially corresponds to the audio signal 102 at the second microphone 524;

subtracting 112 the third audio signal 103 from the second audio signal 102 to provide a fourth audio signal 104 comprising the noise difference between the third 103 and second 102 audio signals, and since the speech portions are substantially the same for second 102 and third 103 audio signals due to the normalization at W 109, subtraction 112 will result in the speech portions cancelling out and only the difference in the noise portions remains, allowing unconstrained optimization of filters H 110 and K 111;

continually filtering 110, 111 the fourth audio signal 104 to provide a fifth audio signal 105 comprising a noise portion corresponding to the noise portion of the second audio signal 102;

obtaining a noise cancelled output speech signal 108 by subtracting 114 the fifth audio signal 105 from a sixth audio signal 106 comprising at least a part of the second audio signal 102, where the sixth audio signal 106 may be the summed signal 107 of the second 102 and third audio 103 audio signals divided by 2, and due to the filtering in W 109, the speech portions are substantially the same for the second and third audio signals and thus these audio signals can be summed.

Figure 2:
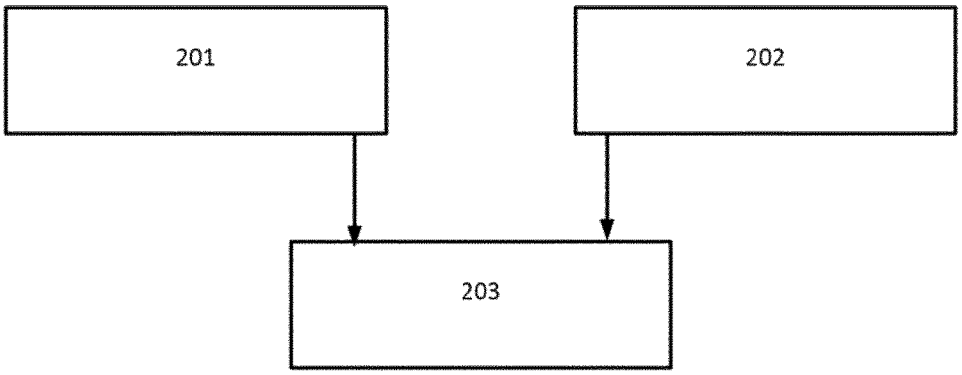
FIG. 2 shows an example of a flow chart illustrating a method for optimizing noise cancellation in a headset.

FIG. 2 shows an example of a flow chart illustrating a method for optimizing noise cancellation in a headset, the headset comprising a headphone and a microphone unit comprising at least a first microphone and a second microphone.

In step 201 at least a first audio signal from the at least first microphone is generated, where the first audio signal comprises a speech portion from a user of the headset and a noise portion from the surroundings.

In step 202 at least a second audio signal from the at least second microphone is generated, where the second audio signal comprises a speech portion from the user of the headset and a noise portion from the surroundings.

In step 203 a noise cancelled output is generated by filtering and summing at least a part of the first audio signal and at least a part of the second audio signal, where the filtering is adaptively configured to continually minimize the power of the noise cancelled output, and where the filtering is adaptively configured to continually provide that at least the amplitude spectrum of the speech portion of the noise cancelled output corresponds to the speech portion of a reference audio signal generated from at least one of the microphones.

FIG. 3 shows examples of a headset, such as a headphone with an attached microphone.

Figure 3A:
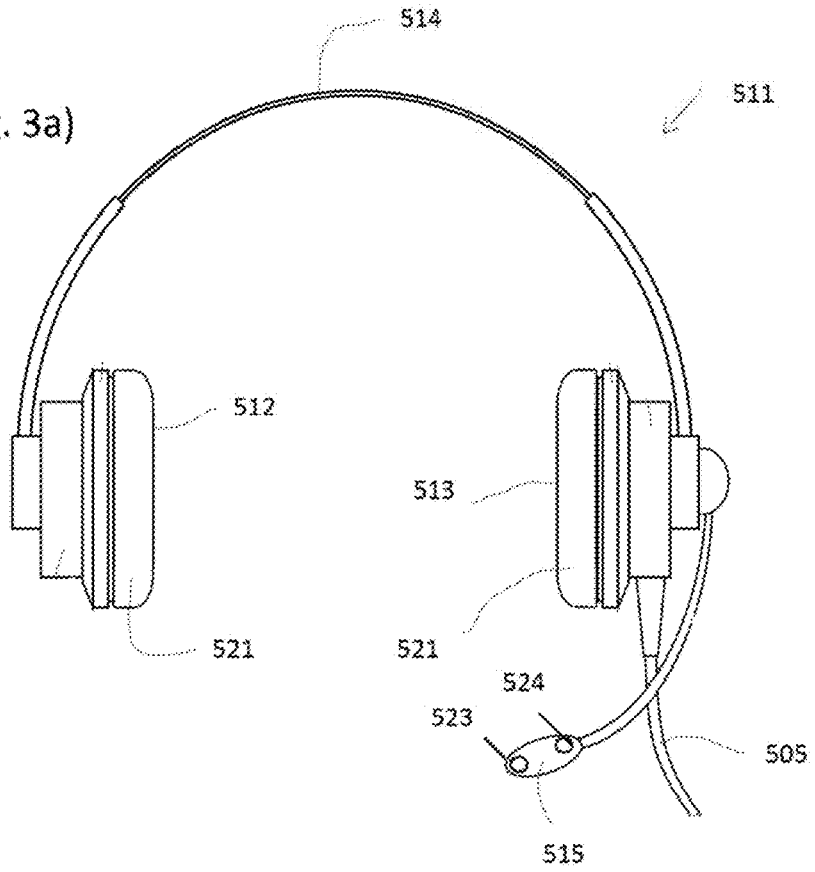
FIGS. 3*a* and 3*b* shows examples of a headset.

In FIG. 3*a*), the headset or headphone 511 comprises two earphones 512, 513 electrically connected by a headband 514. A removable cable 505 is attached in the earphone 513. Each of the earphones 512, 513 comprises ear cushions 521. A microphone boom 515 comprising two microphones 523, 524 is attached on the earphone 513. The two microphones may be a front microphone 523 closest to the mouth of the user and a rear microphone 524 more far away from the mouth of the user. The microphones 523, 524 can be arranged in other positions on the microphone boom than shown in the figure.

Figure 3B:
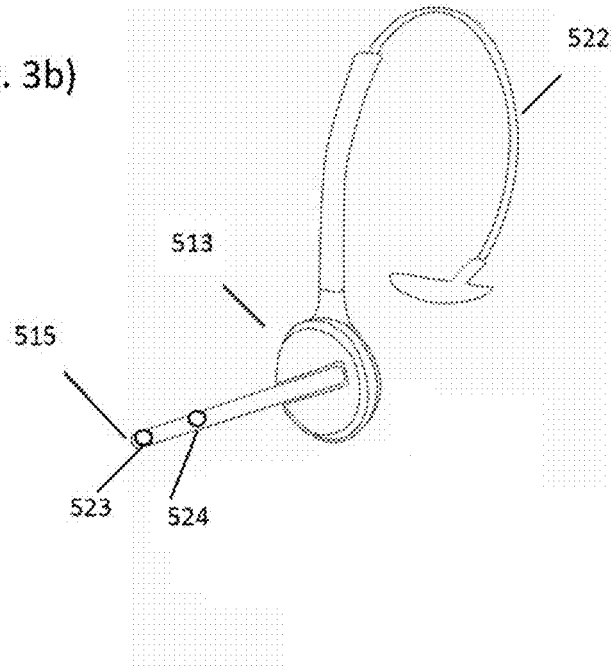

In FIG. 3*b*), the headset or headphone 511 comprises one earphone 513 with an attached microphone boom 515 comprising two microphones 523, 524. A headband 522 is attached to the earphone 513 and shaped to fit on the users head. The two microphones may be a front microphone 523 closest to the mouth of the user and a rear microphone 524 more far away from the mouth of the user. The microphones 523, 524 can be arranged in other positions on the microphone boom than shown in the figure.

Figure 4:
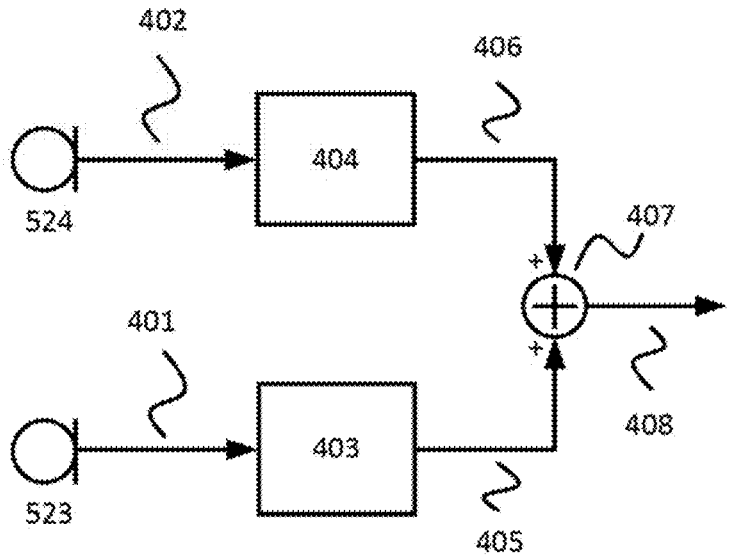
FIG. 4 shows an example of a filter-and-sum beamformer.

FIG. 4 shows an example of a filter-and-sum beamformer.

Minimum variance distortionless response (MVDR) refers to a beamformer which minimizes the output power of the filter-and-sum beamformer subject to a single linear constraint.

In FIG. 4 a first microphone 523 and a second microphone 524 is shown. A first audio signal 401 is generated from the first microphone 523. A second audio signal 402 is generated from the second microphone 524.

Both the first audio signal 401 and the second audio signal 402 are filtered 403 and 404, respectively, and the filtered audio signals 405 and 406, respectively, are summed 407, and a filtered-and-summed output signal 408 is provided.

Although some embodiments have been described and shown in detail, the invention is not restricted to them, but may also be embodied in other ways within the scope of the subject matter defined in the following claims. In particular, it is to be understood that other embodiments may be utilised and structural and functional modifications may be made without departing from the scope of the present invention.

In device claims enumerating several means, several of these means can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The features of the method described above and in the following may be implemented in software and carried out on a data processing system or other processing means caused by the execution of computer-executable instructions. The instructions may be program code means loaded in a memory, such as a RAM, from a storage medium or from another computer via a computer network. Alternatively, the described features may be implemented by hard-wired circuitry instead of software or in combination with software.

The invention claimed is:

1. A method for optimizing noise cancellation in a headset of uncalibrated microphones, and regardless and irrespective of the position of the microphones, the headset comprising a headphone and a microphone unit comprising at least first and second microphones, the method comprising:

using the first and second microphones which are uncalibrated with respect to a user mouth position;

generating at least a first audio signal from the at least first microphone, where the first audio signal comprises a first speech portion from a user of the headset and a first noise portion from the surroundings;

generating at least a second audio signal from the at least second microphone, where the second audio signal comprises a second speech portion from the user of the headset and a second noise portion from the surroundings;

generating a noise cancelled output by filtering and summing at least a part of the first audio signal and at least a part of the second audio signal, where the filtering is adaptively configured to continually minimize the power of the noise cancelled output, where the filtering is continually being adapted to provide that at least an amplitude spectrum of the speech portions of the noise cancelled output corresponds to the speech portion of a reference audio signal generated from at least one of the microphones independently of and regardless of the position of the first and second microphones with respect to the user, and wherein adaption of the steering vector in a Minimum Variance Distortionless Response (MVDR) is performed when speech from the user is detected.

2. The method according to claim 1, wherein one of the first or second microphones is a voice microphone and the other of said first or second microphones is a reference microphone and wherein the method includes selecting the reference microphone to be substantially insensitive to its position relative to the user's mouth.

3. The method according to claim 1, wherein the filtering of the one or more audio signals is adaptively configured by a least mean squares computation.

4. The method according to claim 1, wherein the method comprises performing a noise suppression on the noise cancelled output speech signal.

5. The method according to claim 1, wherein the method comprises normalizing gain of a speech level after noise cancellation.

6. The method according to claim 1, wherein the first microphone is a front microphone and the second microphone is a rear microphone of a microphone boom of the headset.

7. The method according to claim 1, wherein a (GSC) Generalized Sidelobe Cancellation speech cancelling filtering of the one or more audio signals is continually adapted, when speech from the user is detected.

8. The method according to claim 1, wherein a GSC noise cancelling filter adaptation is performed, when speech from the user is detected to be absent.

9. A headset for voice communication, the headset comprising:

a speaker, at least a first and a second microphone for picking up incoming sound and generating a first audio signal generated at least partly from the at least first microphone and a second audio signal being at least partly generated from the at least second microphone, wherein the first audio signal and the second audio signal comprise a speech portion from a user of the headset and a noise portion from the surroundings;

both microphones being positionally uncalibrated;

a signal processor being configured to:

generate a noise cancelled output by filtering and summing at least a part of the first audio signal and at least a part of the second audio signal, where the filtering is adaptively configured to continually minimize the power of the noise cancelled output, and where the filtering is adaptively configured to continually provide that at least the amplitude spectrum of the speech portion of the noise cancelled output corresponds to the speech portion of a reference audio signal generated from at least one of the microphones independently of and regardless of the position of the first and second microphones with respect to the user.

10. The headset according to claim 9, wherein the headset comprises a microphone boom, where the microphone boom is rotatable around a fixed point, where the fixed point is adapted to be arranged at an ear of the user of the headset; and wherein the second microphone is substantially insensitive to its position relative to the user's mouth.

11. The headset according to claim 9, wherein the microphone boom is adjustable, such as the microphone boom is configured with an adjustable length, an adjustable angle of rotation, and/or adjustable microphone positions.

12. The headset according to claim 9, wherein filtering is a filter and sum technique.

13. The headset of claim 9 wherein the filtering comprises normalizing the first audio signal to the second audio signal by providing amplitude matching of the first speech portion of the first audio signal relative to the speech portion of the second audio signal within a predetermined frequency range.

14. A headset for voice communication, the headset comprising:

a speaker, at least a first and a second microphone for picking up incoming sound and generating a first audio signal generated at least partly from the at least first microphone and a second audio signal being at least partly generated from the at least second microphone, wherein the first audio signal and the second audio signal comprise a speech portion from a user of the headset and a noise portion from the surroundings;

both microphones being uncalibrated;

a signal processor being configured to:

generate a noise cancelled output by filtering and summing at least a part of the first audio signal and at least a part of the second audio signal, where the filtering is adaptively configured to continually minimize the power of the noise cancelled output, where the filtering is adaptively configured to continually provide that at least the amplitude spectrum of the speech portion of the noise cancelled output corresponds to the speech portion of a reference audio signal generated from at least one of the microphones;

continually normalizing the first audio signal relative to the second audio signal to provide a third audio signal;

subtracting the third audio signal from the second audio signal to provide a fourth audio signal comprising the noise difference between the third and second audio signals;

continually filtering the fourth audio signal to provide a fifth audio signal comprising a noise portion corresponding to the noise portion of the second audio signal;

wherein filtering is a filter and sum technique and wherein the filtering comprises summing the second and third audio signals to create a seventh audio signal and multiplying the seventh audio signal by one-half to create a sixth audio signal.

15. A method for optimizing noise cancellation in a headset of uncalibrated microphones, the headset comprising a headphone and a microphone unit comprising at least first and a second microphones, the method comprising:

using the first and second microphones which are uncalibrated with respect to a user mouth position;

generating at least a first audio signal from the at least first microphone, where the first audio signal comprises a first speech portion from a user of the headset and a first noise portion from the surroundings;

generating at least a second audio signal from the at least second microphone, where the second audio signal comprises a second speech portion from the user of the headset and a second noise portion from the surroundings;

generating a noise cancelled output by filtering and summing at least a part of the first audio signal and at least a part of the second audio signal, where the filtering is adaptively configured to continually minimize the power of the noise cancelled output, where the filtering is continually being adapted to provide that at least an amplitude spectrum of the speech portions of the noise cancelled output corresponds to the speech portion of a reference audio signal generated from at least one of the microphones irrespective and regardless of the position of the first and second microphones with respect to the user, and wherein a Generalized Sidelobe Cancellation speech cancelling filtering of the first or second audio signals is continually adapted, when speech from the user is detected.

16. The method according to claim 15, wherein adaption of a noise covariance input to a MVDR computation is performed, when no speech from the user is detected.

* * * * *